US005654610A

United States Patent [19]

Cassarly et al.

[11] Patent Number: 5,654,610

[45] Date of Patent: Aug. 5, 1997

[54] ELECTRODELESS DISCHARGE LAMP HAVING A NEON FILL

[75] Inventors: William J. Cassarly; John M. Davenport, both of Lyndhurst; Thomas R. Stanton, Solon; Joseph M. Allison, Euclid, all of Ohio

[73] Assignee: General Electric Company, Schenectady, N.Y.

[21] Appl. No.: 533,297

[22] Filed: Sep. 25, 1995

[51] Int. Cl.[6] ..... H05B 41/16

[52] U.S. Cl. ..... 315/248; 315/344; 315/307; 315/200 A

[58] Field of Search ..... 315/248, 344, 315/209 R, 291, 307, 308, 58, 85, 39, 200 A; 313/113, 161

[56] References Cited

U.S. PATENT DOCUMENTS

| | | | |
|---|---|---|---|
| 4,119,889 | 10/1978 | Hollister | 315/248 |
| 4,240,010 | 12/1980 | Buhrer | 315/248 |
| 5,175,476 | 12/1992 | Anderson et al. | 315/248 |
| 5,406,177 | 4/1995 | Nerone | 315/307 |
| 5,412,280 | 5/1995 | Scott et al. | 315/248 X |
| 5,412,288 | 5/1995 | Borowiec et al. | 315/248 |
| 5,465,028 | 11/1995 | Antonis et al. | 315/248 |
| 5,523,655 | 6/1996 | Jennato et al. | 315/246 |

*Primary Examiner*—Robert Pascal
*Assistant Examiner*—Haissa Philogene
*Attorney, Agent, or Firm*—George E. Hawranko

[57] ABSTRACT

An electrodeless neon discharge light source having a red color light output is provided for use in automotive applications. The light source has a lamp envelope containing a fill of neon gas which, when excited to a discharge state by introduction of an operating signal over a tuned circuit consisting of a resonant capacitor and a ferrite coil, produces a red color light output. A flash control input to a ballast circuit arrangement provides the ability to control the light output using bursts of high frequency sinusoidal energy. The use of the burst signal approach allows for providing varying levels of light intensity output thereby signifying the distinction between braking conditions and an on condition of the tail light. Furthermore, by controlling the rate of flashing of the light source, an indication of a hard braking or emergency condition, could be conveyed.

11 Claims, 1 Drawing Sheet

ELECTRODELESS DISCHARGE LAMP HAVING A NEON FILL

FIELD OF THE INVENTION

This invention relates to a low pressure electrodeless discharge lamp which utilizes a neon fill so as to produce a red light output. More specifically, this invention relates to such a discharge lamp as could be utilized for tail light and signalling purposes in automotive applications.

BACKGROUND OF THE INVENTION

Electrodeless discharge lamps have been the subject of significant development efforts lately because of the known energy efficiency and long life characteristics. Such development efforts have been directed to the task of producing such a lamp at a reasonable cost to consumers and one which exhibited performance characteristics that were well within requirements relating to EMI (electro-magnetic interference). Examples of such electrodeless lamps can be found in U.S. Pat. Nos. 5,412,280 and 5,412,288 both of which are assigned to the same assignee as the present invention. It can be seen that this lamp is a low pressure discharge lamp which is configured in the form of a fluorescent reflector lamp and as such, includes a phosphor coating for generating a white light output for commercial and residential lighting applications. It is because of these long life and energy efficiency characteristics that a discharge lamp is being proposed for an automotive application where it is necessary to provide a flashing operation. However, although effective for providing an efficient, long-life lighting product, modifying such a lamp to provide a red light output would require the use of a red phosphor material. It is impractical to provide a red phosphor to achieve the desired red light output since a red phosphor electrodeless fluorescent lamp would have low efficacy values at low temperatures, such low temperatures being an unavoidable condition for automotive applications.

One way to provide a new type of red tail light/signalling lamp for automotive applications would be to utilize a neon fill, i.e. the new lamp is substantially void of phosphor in conjunction with known lamp types such as a standard electroded discharge lamp. Such a neon lamp would be an improvement for automotive lighting designers as compared to a standard halogen, incandescent lamp because of the faster turn on times that could be achieved for a discharge lamp in comparison to an incandescent lamp. However, one problem that arises with the typical implementation of neon in a gas discharge lamp is that a cold cathode system (that is, one which does not preheat the cathodes for easier starting) must use high voltages to insure reasonable efficiency. In an automotive application, it would not be appropriate to use such high voltages at a location near gasoline. Additionally, it has been measured that the luminous efficacy of a cold cathode neon lamp is on the order of approximately 3 to 7 lumens per watt (LPWs). If a hot cathode neon lamp were to be utilized, there is typically a reduction in the life of such lamp as well as an increase in the cost of manufacture. Moreover, it has been measured that such a hot cathode neon discharge light source would only achieve a luminous efficacy of approximately 15 LPWs. Accordingly, it would be advantageous to achieve a light source which could provide the necessary red color light output without the cost and disadvantages of either a cold or a hot cathode discharge lamp arrangement and yet could also achieve a luminous efficacy of greater than approximately 20 LPWs.

An additional problem that would be experienced because of the presence of electrodes in a standard electroded discharge lamp is the fact that for automotive signalling purposes, it is necessary to flash the light in an on and off condition as for instance, for a turn signal. It is known that for an electroded discharge lamp, the long life characteristics are at least partially due to a condition whereby the lamp can be turned on and left on for a significant period of time, when it is necessary to utilize such a lamp in a flashing manner, electrode degradation, typically tungsten sputtering, can occur. This electrode degradation is a life-limiting mechanism for electroded lamps. Accordingly, it would be advantageous if a light source could be provided that had the long life and energy efficiency characteristics of a discharge light source but yet could be utilized in an automotive application requiring signalling and tail light performance.

SUMMARY OF THE INVENTION

The present invention contemplates a new and improved lighting system for automotive applications whereby the tail light and signalling functions are performed by an electrodeless discharge lamp which allows for generating a red color light output with a luminous efficacy of greater than approximately 20 LPWs and further allows for operation of such lamp at a reasonable operating voltage and with an ability to provide a varying range of flashing rates.

In accordance with the principles of the present invention, there is provided a low pressure electrodeless discharge lamp capable of producing a red color light output and which comprises a lamp envelope having a fill of neon gas, i.e. the new lamp is substantially void of phosphor contained therein. A ferrite coil member is disposed in a position relative to the lamp envelope so that the lamp envelope substantially surrounds at least a portion of the ferrite coil member. A ballast circuit arrangement is coupled to the ferrite coil member and is effective for producing from a conventional input source, an operating signal. The operating signal is coupled through the ferrite coil member to the neon gas fill so as to drive the neon gas fill to a discharge state thereby producing the red color light output.

In one aspect of the present invention, the ballast circuit arrangement includes a capacitor member which, together with the ferrite coil member, comprise a tuned circuit for delivering the operating signal to the gas fill contained within the lamp envelope. The tuned circuit produces the operating signal in the form of a high frequency sinusoidal signal which, by varying the duration of the on and off portions of the operating signal, can produce varying flashing rates of the light output. In this manner, the light output of the gas discharge lamp of the present invention can be structured so as to convey additional information to other drivers, for instance, a rapidly flashing light output could signify a hard braking or emergency type of stop whereas a slower flashing rate could signify a normal turn signal operation.

BRIEF DESCRIPTION OF THE DRAWINGS

In the following detailed description, reference will be made to the attached drawings in which.

DETAILED DESCRIPTION OF THE INVENTION

Figure 1:
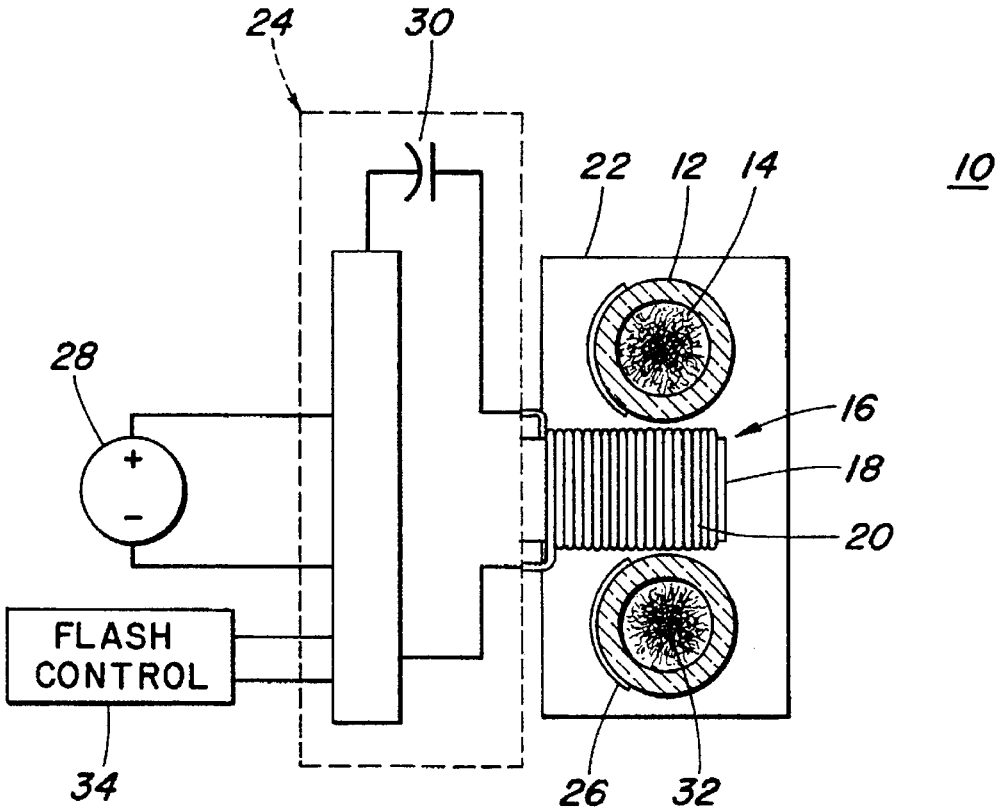
FIG. 1 is an elevational view in section of an electrodeless discharge lamp constructed in accordance with the present invention.

As seen in FIG. 1, an low pressure electrodeless discharge lamp which is capable of producing a red color light output for automotive applications is shown generally as reference 10 and includes a lamp envelope 12 having contained therein, a fill of neon gas 14. The lamp envelope 12 surrounds a ferrite coil member 16 which has a center core portion 18 and a winding 20 disposed thereon. For purposes of mounting only, a cover 22 is disposed around the lamp envelope 12 and coil 16 configuration. The cover 22 is made of a light transmissive material at least at the front portion thereof, that is, at the portion facing away from the ballast circuit arrangement 24 to be described hereinafter in further detail. A reflective coating 26 can be applied to a portion of the lamp envelope 12 so as to direct the light output towards the front portion of the cover 22.

Figure 2:
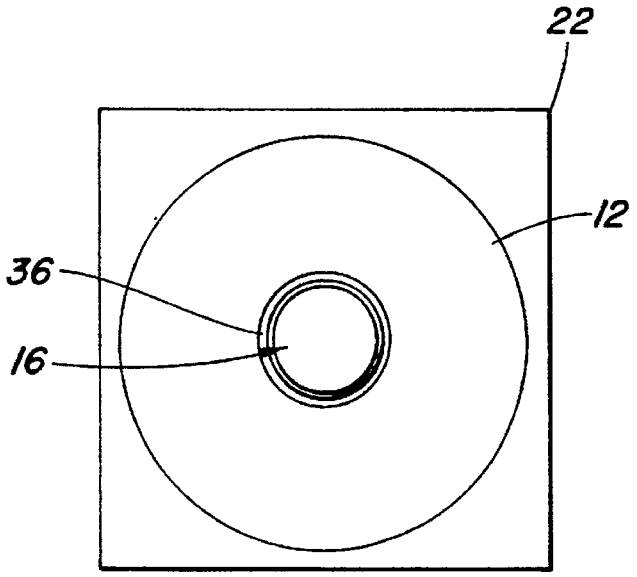
FIG. 2 is an top view of the electrodeless discharge lamp of FIG. 1

The ballast circuit arrangement shown generally as reference 24 is effective for receiving input power, shown in this instance as a DC source 28 given that an automotive application is described, and converting such input power into an operating signal that can be coupled through the ferrite coil member 16 to the fill 14 contained within the lamp envelope 12. Of course, it should be understood that the input power could be of any suitable arrangement including an AC source. For a detailed description of the configuration of the ballast circuit arrangement 24, reference is hereby made to U.S. Pat. No. 5,406,177 issued to Louis R. Nerone on Apr. 11, 1995 which patent is assigned to the same assignee as the present invention and is herein incorporated by reference. A converter portion (not shown) of the ballast circuit of the incorporated reference drives a tuned circuit which consists of the ferrite coil member 16 and a resonant capacitor member 30. The tuned circuit is effective for introducing the operating signal to the fill 14 contained within the lamp envelope 12 and thereby driving the fill to a discharge state so that the red color light output is generated. Generally, the discharge, shown in FIG. 1 as reference 32, will take the shape of a torroid; as such, the shape of the lamp envelope 12 will typically follow the shape of the discharge and therefore, in this instance, the lamp envelope 12 is also shaped torroidally as seen in FIG. 2. As further seen in FIG. 2, the ferrite coil member 16 is disposed substantially at the center of an opening 36 formed in the lamp envelope 12.

In operating any light source as a tail light, signalling light for an automotive application, it is necessary to provide for the ability to flash the light thereby indicating a turning condition. Additionally, it is further necessary to provide for two different levels of light intensity, one indicating merely that the tail lights are on and the other indicating a braking condition. As such, it is necessary to provide for some control on the operation of the light source 10 of the present invention. In order to control the operation of the light source 10 of the present invention, a form of pulse width modulation is proposed whereby a waveform of a high frequency sinusoidal signal selectively controlled to an on and an off condition is used to drive the fill 14 to the discharge state through the tuned circuit consisting of the resonant capacitor 30 and the ferrite coil 16. This form of modulation is achieved by use of a flash control arrangement 34 which essentially provides a burst of the high frequency sinusoidal signal during the on condition which by controlling the duration of the on condition, can control the intensity of the light output down to a very low level, that is, to essentially a zero light output if so desired. In this manner, the distinction between the normal tail light operation and the braking light operation can be achieved in addition to the operation of turning the light output off and then on again in a flashing manner to signify a turn signal operation.

The use of the burst control of operating the light source 10 for tail light and turn signal types of conditions, it is also possible to use the burst control to convey other information to nearby drivers. For instance, by indicating a rapidly flashing condition of the light source 10, the driver could provide an indication of a hard braking condition such as might occur in an emergency situation. The flash control arrangement 34 can provide that for an extremely rapid and forceful brake application, the rapid flashing condition can be indicated. Such an operation would not otherwise be possible with a conventional incandescent lamp such as a halogen lamp because of the inability to provide a rapid change in the on and off conditions of such a light source. Moreover, a halogen lamp output is limited by the car battery voltage applied to the lamp and the lamp's design power level. Pulsing a halogen lamp would merely reduce the average light output. For the electrodeless neon discharge light source of the present invention however, the average design power can be maintained whereas the peak power can then be increased. Considering an electrodeless neon discharge light source and a halogen lamp that are designed for the same light output at a constant power level, at a 50% duty cycle, the electrodeless neon discharge lamp would provide two times the light output of a halogen lamp and at a 10% duty cycle, the peak output would be ten times higher for the electrodeless neon discharge lamp.

Although the hereinabove embodiment of the invention constitutes the preferred embodiment, it should be understood that modifications can be made thereto without departing from the scope of the invention as set forth in the appended claims. For instance, it would be possible to use other fill gases than neon to achieve various other color outputs. Also, a halogen lamp can be provided at the center of the ferrite coil to serve as a backup light source. Still further, a dielectric thin film could be used for the reflective coating to improve directionality without shielding the discharge from the ferrite coil. It should also be understood that the light source of the present invention is not limited to automotive applications but could be applied to other lighting applications where a long life, energy efficient operation having the need to provide a flashing operation, were required. For instance, the light source of the present invention could be utilized for emergency vehicles, for airport beacon lighting as well as for school bus flashing light applications.

We claim:

1. A low pressure electrodeless discharge lamp having a red color light output, said discharge lamp comprising:

a lamp envelope, an interior of the lamp envelope being substantially void of a phosphor;

a neon fill gas contained within said lamp envelope;

a coil member disposed relative to said lamp envelope so that said lamp envelope substantially surrounds said coil member; and, a ballast circuit arrangement coupled to said coil member, said ballast circuit arrangement being receptive of input power and being effective so as to produce therefrom, an operating signal which, when coupled to said neon gas fill through said coil member, drives said neon fill to a discharge state thereby producing such red color light output.

2. A discharge lamp as set forth in claim 1 further comprising a reflective coating disposed on a portion of said lamp envelope so as to direct such red color light output in a specific direction.

3. A discharge lamp as set forth in claim 1 wherein said lamp envelope is torroidally shaped and said coil member is disposed within a central opening portion thereof.

4. A tail light and signalling lighting system for automotive applications comprising:

a low pressure electrodeless discharge lamp having a lamp envelope containing a neon gas fill, an interior of the lamp envelope being substantially void of a phosphor;

a coil member at least partially disposed within an opening formed in said lamp envelope;

a ballast circuit arrangement coupled to said coil member, said ballast circuit arrangement being receptive of input power and being effective so as to produce from said input power, an operating signal, said operating signal, when coupled to said neon gas fill through said coil member, driving said neon gas fill to a discharge state thereby producing red color light output; and, wherein said operating signal is selectively turned to an on and an off condition so as to provide a flashing light output.

5. A lighting system as set forth in claim 4 wherein the duration of said on and off conditions of said operating signal is adjusted relative to one another so as to provide a difference in flash rate.

6. A lighting system as set forth in claim 5 wherein an emergency flash rate is provided by adjustment of said on and off conditions of said operating signal, said emergency flash rate having a higher flashing rate than a flash rate corresponding to a normal condition.

7. A discharge lamp as set forth in claim 3 wherein the coil member is ferrite.

8. A lighting system as set forth in claim 6 wherein the coil member is ferrite.

9. A lighting system as set forth in claim 8 wherein said ballast circuit arrangement includes a capacitor member which, in cooperation with said ferrite coil member, generates said operating signal, said capacitor and ferrite coil member being tuned so as to provide said operating signal as a high frequency, sinusoidal signal.

10. A lighting system as set forth in claim 9 wherein burst width modulation of the high frequency signal is used to selectively control a perceived light intensity, the bursts having a repetition rate higher than 100 bursts per second and the perceived light intensity being controlled by a duty cycle of the burst modulation.

11. A tail light and signalling lighting system for automotive applications comprising:

a low pressure electrodeless discharge lamp having a lamp envelope containing a neon gas fill;

a coil member at least partially disposed within an opening formed in said lamp envelope;

a ballast circuit arrangement coupled to said coil member, said ballast circuit arrangement being receptive of input power and being effective so as to produce from said input power, an operating signal, said operating signal, when coupled to said neon gas fill through said coil member, driving said neon gas fill to a discharge state thereby producing red color light output;

wherein said operating signal is selectively turned to an on and an off condition so as to provide a flashing light output; and, wherein a form of pulse width modulation provides bursts of the operating signal during the on condition, an intensity of the light output being controlled by the bursts.

* * * * *